US007428878B2

(12) United States Patent
Kim

(10) Patent No.: US 7,428,878 B2
(45) Date of Patent: Sep. 30, 2008

(54) WHISTLE

(76) Inventor: Keun Jung Kim, 6823 Union Mill Rd., Clifton, VA (US) 20124

( * ) Notice: Subject to any disclaimer, the term of this patent is extended or adjusted under 35 U.S.C. 154(b) by 0 days.

(21) Appl. No.: 11/455,859

(22) Filed: Jun. 20, 2006

(65) Prior Publication Data

US 2007/0289523 A1 Dec. 20, 2007

(51) Int. Cl.
*G10K 5/00* (2006.01)

(52) U.S. Cl. ..... 116/137 R; 116/140; 446/204

(58) Field of Classification Search ..... 116/137 R, 116/140, 142 R, 143–146, 142 FP; 446/202–209, 446/213, 216, 416; 84/380 R, 330
See application file for complete search history.

(56) References Cited

U.S. PATENT DOCUMENTS

| | | | | | |
|---|---|---|---|---|---|
| 394,243 | A * | 12/1888 | Briggs | 446/206 |
| 537,792 | A * | 4/1895 | Wardwell et al. | 446/205 |
| 547,100 | A * | 10/1895 | White | 446/205 |
| 696,814 | A * | 4/1902 | Hatch | 446/206 |
| 1,626,198 | A * | 4/1927 | Jacquemin | 446/204 |
| 1,688,349 | A * | 10/1928 | Petrie | 446/26 |
| 1,748,460 | A * | 2/1930 | Petrie | 446/205 |
| 1,867,903 | A * | 7/1932 | Wilcox | 446/205 |
| 2,113,396 | A * | 4/1938 | Butterfield | 446/205 |
| 2,204,701 | A * | 6/1940 | Robinson | 84/330 |
| 2,246,266 | A * | 6/1941 | Robinson | 84/330 |
| 2,555,833 | A * | 6/1951 | Vanaman | 84/330 |
| 2,877,598 | A * | 3/1959 | Seron | 446/204 |
| 3,824,949 | A * | 7/1974 | Aquila | 116/137 R |
| 4,359,961 | A * | 11/1982 | Seron | 116/137 R |
| 4,709,651 | A * | 12/1987 | Lance | 116/137 R |
| 5,086,726 | A * | 2/1992 | Sharp | 116/137 R |
| 5,251,569 | A * | 10/1993 | Seron | 116/137 R |
| 5,329,872 | A * | 7/1994 | Wright | 116/137 R |
| 5,495,820 | A * | 3/1996 | Seron | 116/137 R |
| 5,507,246 | A * | 4/1996 | Rand, Jr. | 116/137 R |
| 5,564,360 | A * | 10/1996 | Wright | 116/137 R |
| 6,413,139 | B1 * | 7/2002 | Douglas | 446/204 |
| 6,837,177 | B2 * | 1/2005 | Tanaka | 116/137 R |
| 7,357,693 | B1 * | 4/2008 | Roberts | 446/216 |
| 2003/0116078 | A1 * | 6/2003 | Topman et al. | 116/137 R |
| 2006/0272568 | A1 * | 12/2006 | Neidlinger et al. | 116/137 R |
| 2007/0289523 | A1 * | 12/2007 | Kim | 116/137 R |

* cited by examiner

*Primary Examiner*—R. A. Smith
*Assistant Examiner*—Amy Cohen Johnson

(57) ABSTRACT

A new whistle which emits louder sound level with easiness of blowing air through the whistle. It direct the sound to intended subject by having sound opening area in front of the whistle to direct sound waves to go forward motion and it has capacity to change the insert able wound chamber and insert able sound chambers are attach able to each others. Also using a sound reflector and angled air tunnel on whistle with opening on top can be used to make sound waves go forward.

6 Claims, 5 Drawing Sheets

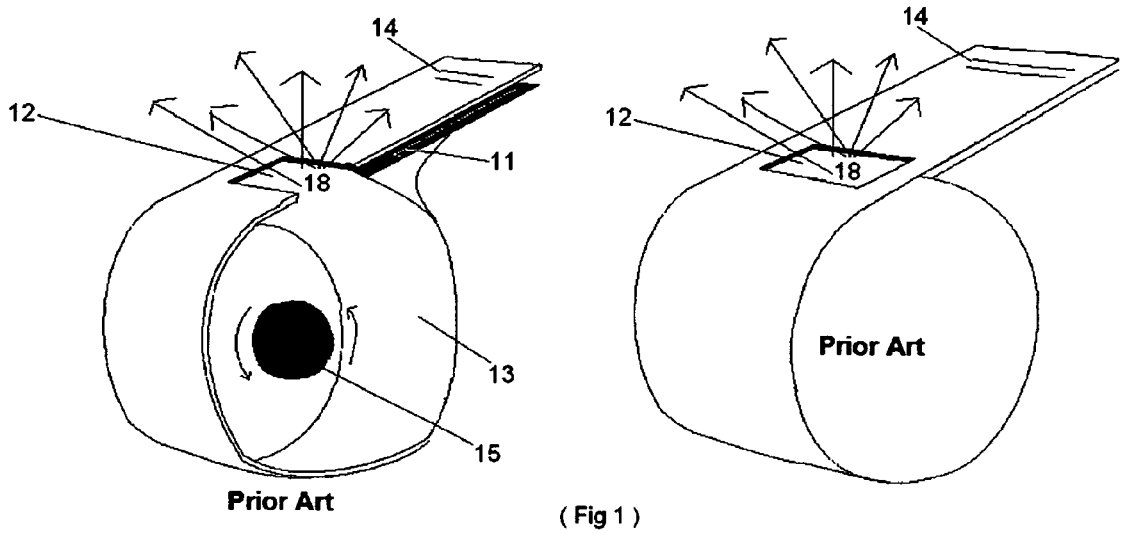
( Fig 1 )
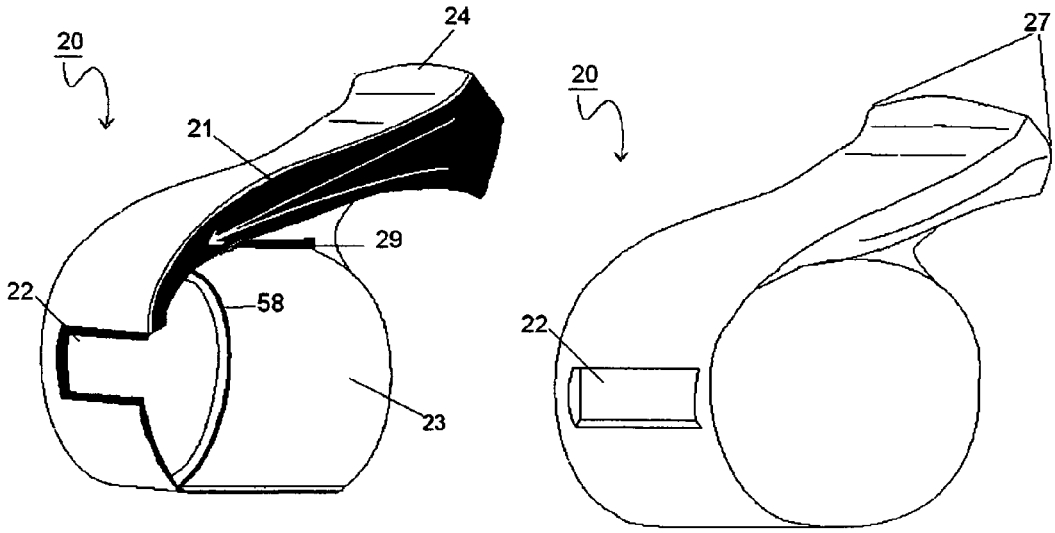
( Fig 2 )

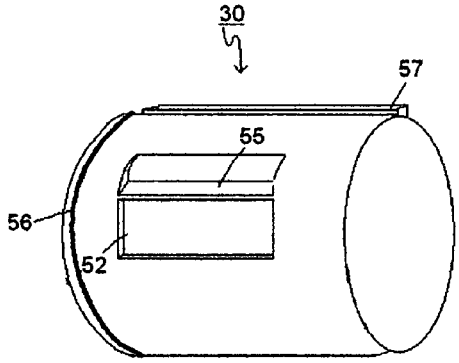
( Fig 3 )
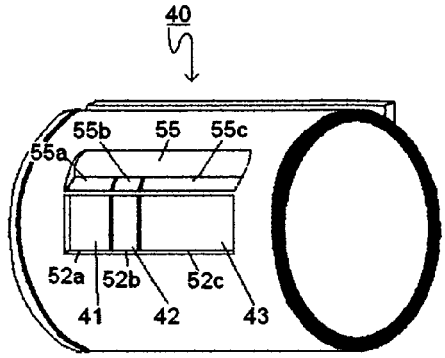
( Fig 4 )
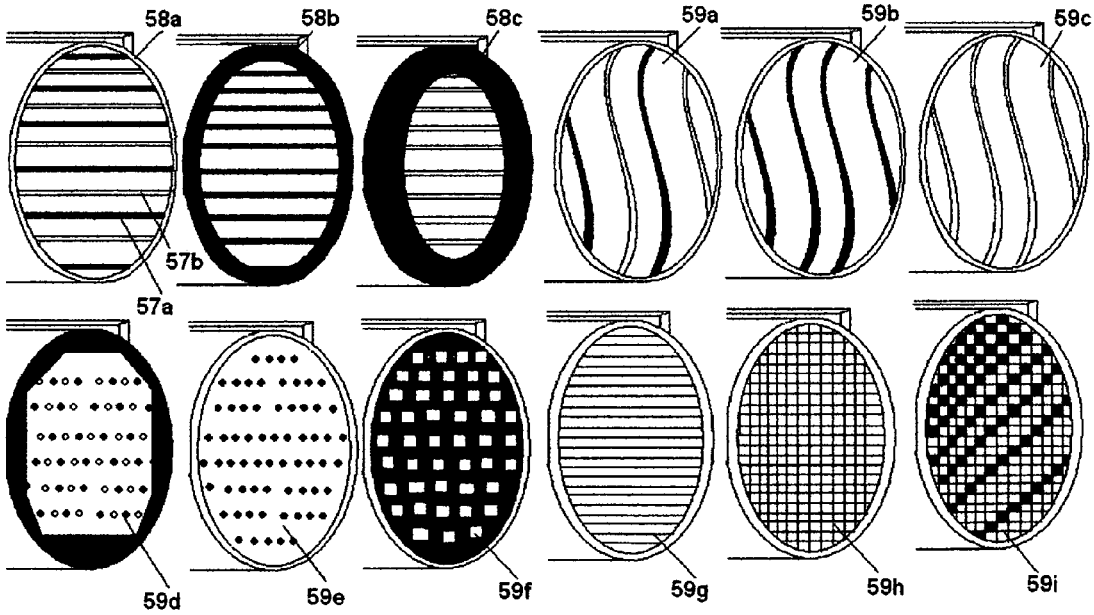
( Fig 5 )

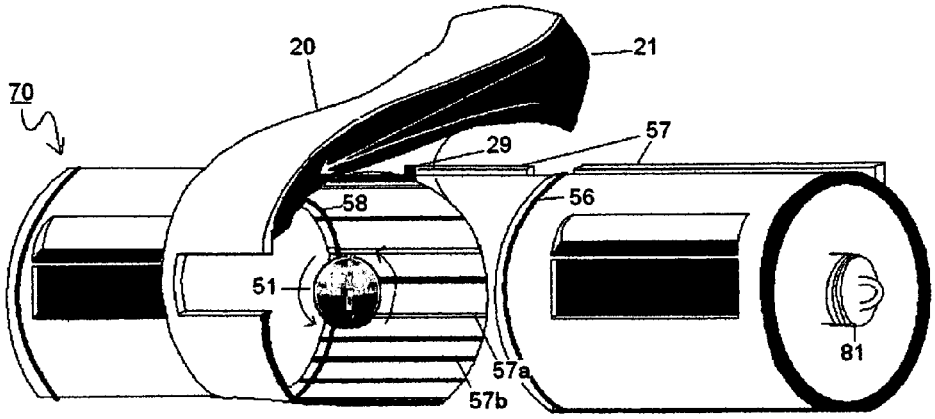
( Fig 6 )
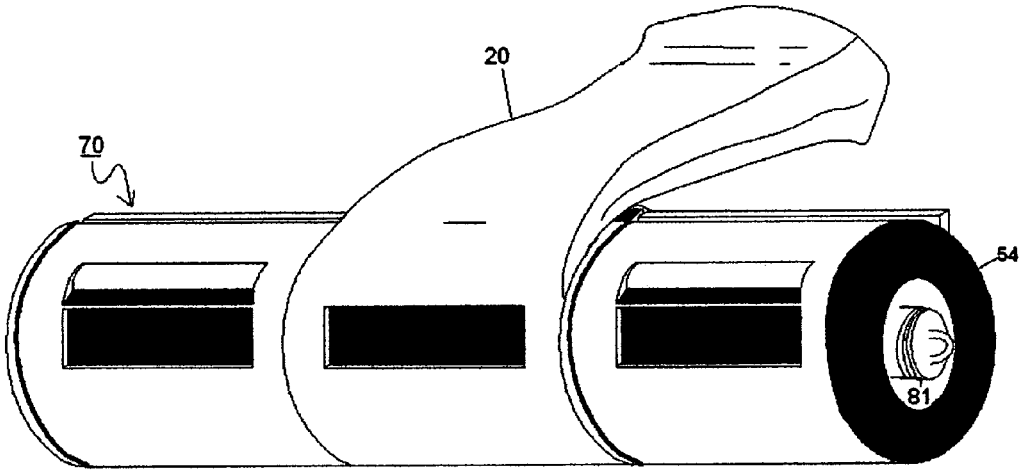
( Fig 7 )
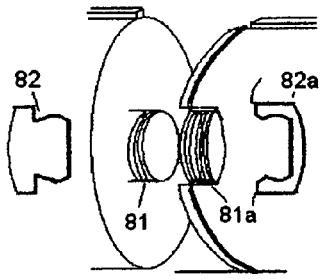
( Fig 8 )

WHISTLE

CROSS-REFERENCE TO RELATED APPLICATIONS (not applicable )

STATEMENT REGARDING FEDERALY SPONSORED RESEARCH OR DEVELOPMENT (not applicable )

REFERENCE TO SEQUENTIAL LISTING, A TABLE, OR A COMPUTER PROGRAM LISTING APPENDIX SUBMITTED ON A COMPACT DISC (not applicable )

BACKGROUND OF THE INVENTION

1) Field of the Invention

This invention relates to a whistle or signaling device which produce louder sound to the subject it trying to reach with interchangeable sound chamber which has all different types of tone and multi tone of user's choosing. Also it reduces sound level to the user's ear drum. This whistle's mouth piece is shaped in such way it is comfortable but stay firmly in the mouth. By shape, it allow larger volumes of air into the interchangeable sound chamber. Also using attachments on existing whistle to make the sound waves go forward.

2) Description of the Related Art

It is known to use a mouth blown device so call whistle to guide traffic or sports events, and also signaling someone of dangers. Traditional whistle which holds a cork pea in a sound chamber or pea less produce sound for these purpose. The deficiency of traditional whistle is that whistle have sound opening at the top or topside of the whistle. Sound travels through vibrations in the air and all the vibrated sound generated by the traditional whistle device will go up ward rather than the subject it intended to alert and sound generated by the whistle to be heard by the users ear, loud due to the short distance from whistle to ear. Which will damage the user's ear drums. Also traditional whistle device have a narrow inlet of air going into the sound chamber of the device. Which limit's the level of sound wave. Often user try to blow hard to generate more loud sound end up blowing whistle device out of there mouth. In order to resolve blowing out problem there is U.S. Pat. No. 5,546,887 issued to Robert w. Cameron to make whistle device stay in the mouth by having retainer flanges top and bottom of the traditional whistle device. It is good art that whistle will stay in user's mouth with stability. Still the air going through the sound chamber is the same amount due to narrow air tunnel of the whistle and sound opening at top of the whistle which will damage user's ear drums. Also traditional whistle comes with a one choice of sound, and are not interchangeable with different sound of tones. There is U.S. Pat. No. 5,495,820 issued to Suren V. Seron. Which whistle to have plurality of tone altering apertures are located in the body and extend to the chamber. It is good to change tone but can not have different sound.

U.S. Pat. No. 4,709,651 issued to Mark A. Lance and U.S. Pat. No. 5,816,186 issued to Charles G. Shepherd's whistle produce two different tones at same time also not a different sound.

U.S. Pat. No. 3,824,949 issued to Christopher J. Aquila had good idea using megaphone to direct the sound but it is not convenient to use the system due to long air tube and chain to attach tube to a user also need clip for attachment to the belt of waistband of the user. Longer the blowing tube more resistance inside tube to blow the whistle.

U.S. Pat. No. 4,821,670 Issued to Ronald L. Foxcroft also has sound opening at top and fixed sound chamber.

U.S. Pat. Nos. 5,329,872 and 5,564,360 issued to howard W. Wright have all weather whistle with cover blocks water but it deflect sound waves least 3 times before it release sound wave through opening due to first opening being form toward back in order to have air bubble in case of sumerge in the water.

All above patent mention are fixed body sound chamber and sound chamber are not interchangble and sound opening on the whistle are either on top or top side or back.

SUMMARY OF THE INVENTION

The present invention solved all the problems stated before by placing whistle device's sound outlet on front of the whistle, which allow all the sound generated by the interchangeable sound chamber in a whistle will be send forward motion toward the intended subject.

Also using a sound reflectors and angled air tunnel on a traditional whistle device which has sound opening on top of the whistle to redirect the sound waves forward. By doing it this way, less sound waves will be received by the whistle user, which is less harmful to user's ear drums. Different shapes or sizes, patterns, inside of whistle device's sound chamber will generate different tone and pitch of sound, tone of the whistle will be changed by how grooves or bumps are shaped inside of sound chamber. Whistle device user could customized the tone and volume of there whistle by picking different lay out of interchangeable sound chamber. By enlarging the area where mouth grips the whistle on concave shape to have larger air tunnel and also have a firm grip due to the shape of the whistle device. It is best illustrated by drawing FIG. 2. Since more air is going through the sound chambers, ball will be turn more faster and different grooves and bumps will vibrate the ball vigorously to make more sound waves and different tone of sound which will be sent out at front of the whistle device.

BRIEF DESCRIPTION OF DRAWING

FIG. 1. Cut out perspective view of traditional whistle device with air inlet tunnel and sound chamber with sound outlet and full perspective view.

FIG. 2. Cut out perspective view of new whistle device with larger air inlet tunnel and locking and slide guide of sound chamber and full view.

FIG. 3. Drawing of new whistle device's interchangeable sound chamber.

FIG. 4. Drawing of new whistle device's interchangeable sound chamber with multi chamber.

FIG. 5. Different drawing of new whistle device's interchangeable sound chamber's inner layout and thickness of chambers.

FIG. 6. Cut out view of new whistle device's main embodiment and sound chambers.

FIG. 7. View of new whistle device's main embodiment and interchangeable unit attached together.

FIG. 8. View of new whistle device's interchangeable sound unit's attachment system.

DETAIL DESCRIPTION

Figure 9:
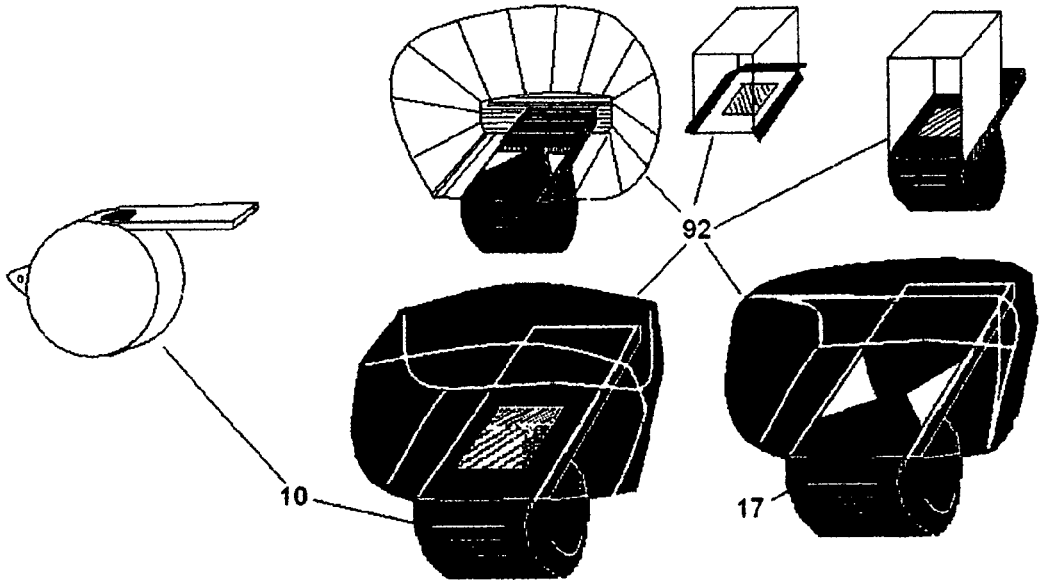
FIG. 9. View of sound reflector put on a traditional whistle.

It clearly show on FIG. 1. A traditional whistle with narrow air inlet tunnel 11 where user blow air into a whistle to make cork pea or ball 15 to bounce around the smooth surface of whistle's sound chamber 13 to make sound warble. After ward forced by the air in the sound chamber, sound waves 18 is pushed out to sound outlet 12 which is located top of the whistle. Where whistle device emit an audible sound signal to alert the intended subject. FIG. 1 also shows flat area of whistle mouth peace area 14. On FIG. 2 shows new whistle device 20 with elongated wide open mouth portion 24 with larger air tunnel 21 with where user's mouth portion area 24 have been curbed up and downward also left and right to fit mouth securely when user blow hard into the air tunnel 21. This way whistle device will not be blown out of the user's mouth also by having sound outlet first opening 22 in front of the whistle, sound will go forward. It also shows guide groove 29 at its inner side and locking groove 58 for sound making insert 30 (FIG. 3), 40 (FIG. 4), 70 (FIG. 7). FIG. 3 shows interchangeable sound making insert 30 with locking ring 56 which will sit in (FIG. 2) locking groove 58 with (FIG. 3) guide track 57 inside of (FIG. 2) guide groove 29 once inside of new whistle embodiment 20, air is forced through air tunnel 21 into (FIG. 3) air inlet area 55 of sound chamber 30.

Figure 10:
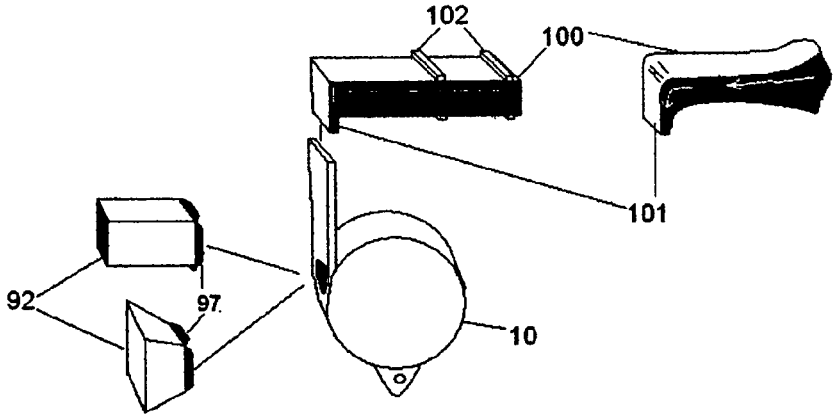
FIG. 10. View of angled air turnel and reflectors used on traditional whistle.
Figure 11:
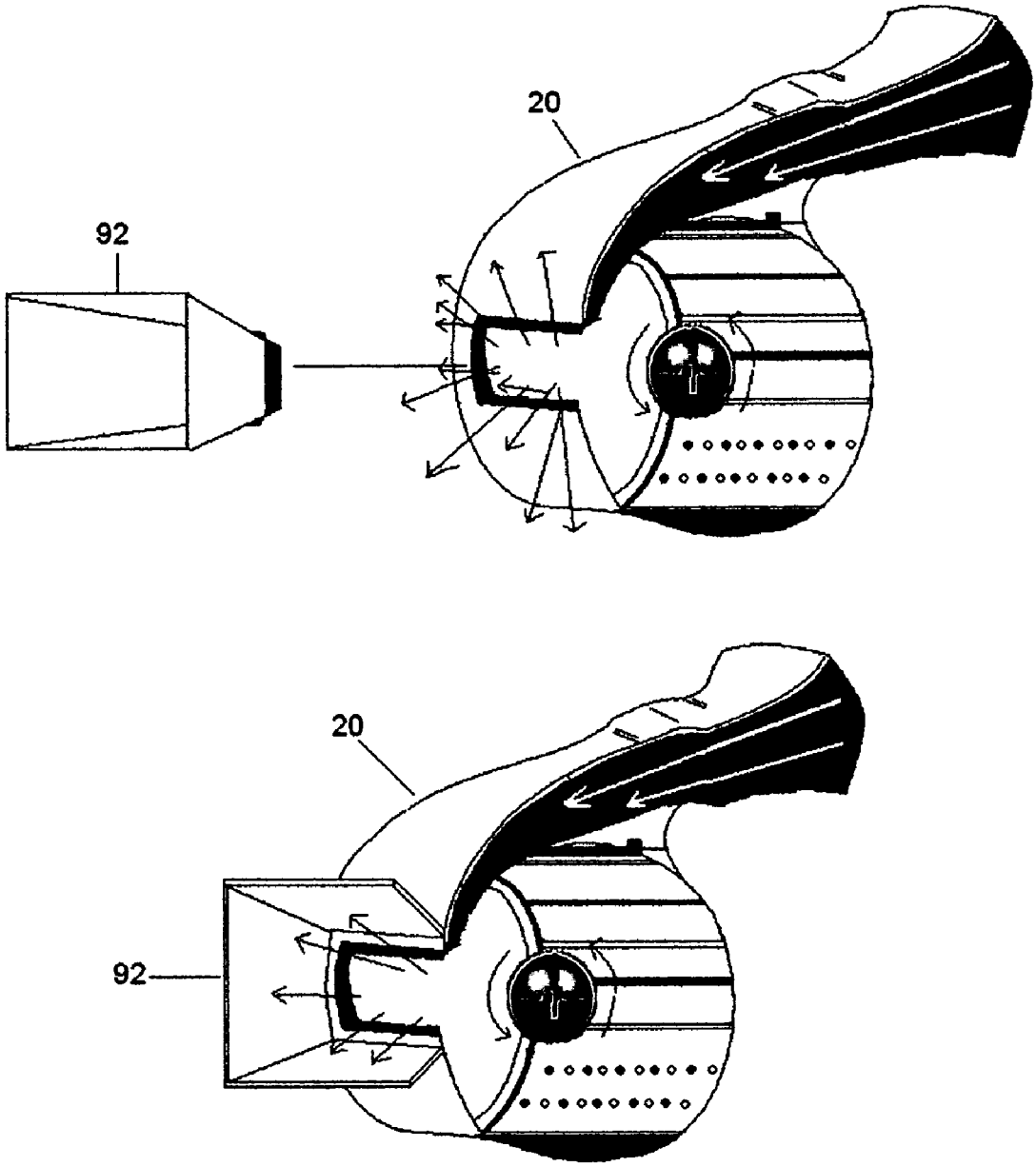
FIG. 11. View of new whistle device with sound reflector.

Which makes sound and release at second opening 52 of sound chamber 30, which passes through first opening 22 of new whistle embodiment 20. FIG. 4 shows 3 sound chamber 41, 42, 43, in one interchangeable sound making insert 40. When air is forced into air inlet area 55 to 3 different sound chamber inlet area 55*a*, 55*b*, 55*c* in order to make different tone and pitch of sound. Once sound is made, it is forced out at second opening 52*a*, 52*b*, 52*c*. Which pass through first opening 22 at front of new whistle embodiment 20. FIG. 5 show sound chamber with grooves 57*a* bump 57*b* which will make cork or ball inside sound chamber agitate even more to make more vibrated sound waves and prevent from ball to stick to chamber wall or over blowing. Also shows thickness of wall 58*a*, 58*b*, 58*c*, which produce different pitch of tone. On FIG. 5 (59*a*-59*i*) shows inside of sound chamber could have any kinds of pattern to make the sound and tone to user's choosing. FIG. 6 is showing partial cut off view of the three interchangeable sound chamber 70 put together with main whistle embodiment 20. The three sound chamber is put together by screw 81 in type. And guide track 57 is fitted into guide groove 29 and hold in place by locking ring 56 is being placed at locking groove 58. When air is forced through, enlarged air tunnel 21 to the sound chamber which moves the pea 51 to make wabling sound and groove 57*a* and bump 57*b* will make even more agitation on a pea 51 in order to produce more sound waves. FIG. 7 showing three sound chamber 70 with thicker chamber walls 54 put together with main whistle embodiment 20. Which will produce higher pitch than thinner wall due to smaller sound chamber and connected by screw in type 81. FIG. 8 showing different way to attached sound chamber together screw type 81,81*a* and click type 82, 82*a*. FIG. 9 is showing different shapes and size of sound reflectors 92 put on a traditional whistle 10 and pea less whistle 17 with top/side openings. Reflector 92 can be attached by tape/glue elements put on a contact area between sound reflectors 92 and traditional whistle 10 and pea less whistle 17. Once sound wave 18 bounce off from sound reflector 92, sound waves 18 are redirect toward forward motion. FIG. 10 shows angled air tunnel 100 which can be put on to the traditional whistle 10 to make traditional whistle's sound waves go forward motion. Angled air tunnel 100 area 101 where traditional whistle's mouth portion is being fitted. Also having bump 102 on the front and end edge of the mouth portion in order to firmly and securely hold at the person's lips. Also sound reflectors 92 can be attached to focus sound waves direction. FIG. 11 shows sound reflector 92 with new whistle device 20 to direct sound waves even more to intended area or subject.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. A whistle comprising:

a whistle body including a mouth piece and a resonating chamber connected thereto, said mouth piece having a concave/angled air tunnel with first end where air is blown into and second end where air is exiting from said concave/angled air tunnel, said second end extending beyond said resonating chamber to said resonating chamber's air inlet so that air under pressure may be introduced directly into said resonating chamber, and said resonating chamber having an air outlet placed at an opposite end side of said mouth piece's first end thereby directly sending sound waves in a linear forward direction.

2. A whistle of claim 1 wherein said resonating chamber comprises multiple chambers in one unit to produce a multi-tone.

3. A whistle comprising:

a whistle body including a mouth piece and a hollow coupling connected thereto, said mouth piece having a concave/angled air tunnel with first end where air is blown into and second end where air is exiting from said concave/angled air tunnel, said second end extending beyond said hollow coupling; wherein said hollow coupling having coupling guide and groove to hold in a resonating chamber; said resonating chamber having an air inlet so that air under pressure may be introduced directly into said resonating chamber and an outlet on an opposite end side of the mouth piece's first end thereby sending sound waves in a direct linear forward direction.

4. A whistle of claim 3 comprising a plurality of resonating chambers; wherein each resonating chamber is attachable or detachable to each other resonating chamber with a coupling means.

5. A whistle of claim 4 wherein each of said plurality of resonating chambers is able to produce a multi-tone.

6. A whistle of claim 3 wherein said resonating chamber comprises a guide track and locking device in order to attach or detach said resonating chamber to said hollow coupling.

* * * * *